US011056769B2

(12) United States Patent
Jeon et al.

(10) Patent No.: US 11,056,769 B2
(45) Date of Patent: Jul. 6, 2021

(54) ELECTRONIC DEVICE COMPRISING ANTENNA

(71) Applicant: SAMSUNG ELECTRONICS CO., LTD., Suwon-si (KR)

(72) Inventors: Seunggil Jeon, Suwon-si (KR); Kyungwoo Lee, Suwon-si (KR); Joohyun Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/661,033

(22) Filed: Oct. 23, 2019

(65) Prior Publication Data

US 2020/0144699 A1 May 7, 2020

(30) Foreign Application Priority Data

Nov. 5, 2018 (KR) ..... 10-2018-0134740

(51) Int. Cl.

| | |
|---|---|
| ***H01Q 1/24*** | (2006.01) |
| ***H01Q 1/48*** | (2006.01) |
| ***H01Q 9/04*** | (2006.01) |
| ***H01Q 5/50*** | (2015.01) |

(52) U.S. Cl.

CPC ..... *H01Q 1/243* (2013.01); *H01Q 1/48* (2013.01); *H01Q 5/50* (2015.01); *H01Q 9/0421* (2013.01)

(58) Field of Classification Search

CPC ..... H01Q 1/241; H01Q 1/243; H01Q 1/44; H01Q 1/48; H01Q 5/50; H01Q 5/335; H01Q 9/0421; H01Q 9/36; H01Q 9/42

See application file for complete search history.

(56) References Cited

U.S. PATENT DOCUMENTS

| | | | |
|---|---|---|---|
| 7,242,352 | B2 | 7/2007 | Tavassoli Hozouri |
| 7,733,279 | B2 | 6/2010 | Hozouri |
| 9,131,037 | B2 | 9/2015 | Corbin et al. |
| 10,164,338 | B2 | 12/2018 | Ganchrow et al. |
| 10,340,592 | B2 | 7/2019 | Nam et al. |
| 10,411,327 | B2 | 9/2019 | Kim et al. |
| 2006/0227052 | A1 | 12/2006 | Tavassoli Hozouri |

(Continued)

FOREIGN PATENT DOCUMENTS

| | | |
|---|---|---|
| JP | 2017-130965 | 7/2017 |
| KR | 10-2018-0013615 | 2/2018 |
| WO | 2006/110564 | 10/2006 |

OTHER PUBLICATIONS

International Search Report dated Feb. 28, 2020 in counterpart International Patent Application No. PCT/KR2019/014515.

*Primary Examiner* — Hoang V Nguyen

(74) *Attorney, Agent, or Firm* — Nixon & Vanderhye P.C.

(57) ABSTRACT

An electronic device may include a housing including a conductive area, a first conductive member comprising a conductive material in electrical contact with the conductive area, a first wireless communication circuit electrically connected to the conductive area, and a second wireless communication circuit electrically connected to the first conductive member. The first wireless communication circuit transmits and/or receives a first signal having a frequency of 6 GHz or less using the conductive area, and the second wireless communication circuit transmits and/or receives a second signal having a frequency of 20 GHz or more using at least part of the first conductive member and the conductive area.

17 Claims, 16 Drawing Sheets

(56) References Cited

U.S. PATENT DOCUMENTS

| | | | | |
|---|---|---|---|---|
| 2009/0109096 | A1 | 4/2009 | Hozouri | |
| 2009/0296527 | A1 | 12/2009 | Cuschieri et al. | |
| 2014/0112511 | A1 | 4/2014 | Corbin et al. | |
| 2016/0254588 | A1 | 9/2016 | Kim et al. | |
| 2017/0062937 | A1 | 3/2017 | Ganchrow | |
| 2018/0034148 | A1 | 2/2018 | Nam et al. | |
| 2018/0076507 | A1* | 3/2018 | Heo | H01Q 5/321 |

* cited by examiner (1)

(2)

(1)

(2)

(1)

(2)

ELECTRONIC DEVICE COMPRISING ANTENNA

CROSS-REFERENCE TO RELATED APPLICATION

This application is based on and claims priority under 35 U.S.C. § 119 to Korean Patent Application No. 10-2018-0134740, filed on Nov. 5, 2018 in the Korean Intellectual Property Office, the disclosure of which is incorporated by reference herein in its entirety.

BACKGROUND

Field

The disclosure relates to an electronic device including an antenna for transmitting and/or receiving a signal with a high frequency.

Description of Related Art

As the built-in antenna scheme is introduced, the antenna is being positioned inside the electronic device. Furthermore, as the metal housing is applied for the rigidity and aesthetics of the electronic device, the antenna having a part of the metal housing as a radiator is being used as a conventional legacy antenna.

With the introduction of the next-generation antenna, methods in which electronic devices are enlarged or the parts of the metal housing are replaced by injection are being applied to mount more antennas.

For example, the next-generation antenna may be disposed inside the electronic device as a module including a printed circuit board, a wireless communication circuit, and a metal radiator. The next-generation antenna module (e.g., 5G) needs to be positioned close to the housing of the electronic device for radiation. At this time, the radiation efficiency of the legacy antennas using at least part of the adjacent housing as a radiator may be reduced. Furthermore, because the feed structures for the legacy antenna and the next-generation antenna are separated, there is a need for the additional space and a separate process may is applied. Moreover, as the display becomes larger, the electromagnetic wave of the internal antenna in the display direction is shielded and the coverage in the corresponding direction may not be secured.

SUMMARY

Embodiments of the disclosure may provide an electronic device including the next-generation antenna capable of using a part of the metal housing, which is the radiator of the legacy antenna, as a radiator.

According to an example embodiment of the disclosure, an electronic device may include a housing including a conductive area, a first conductive member comprising a conductive material in electrical contact with the conductive area, a first wireless communication circuit electrically connected to the conductive area, and a second wireless communication circuit electrically connected to the first conductive member. The first wireless communication circuit is configured to transmit and/or receive a first signal having a frequency of 6 GHz or less using the conductive area, and the second wireless communication circuit is configured to transmit and/or receive a second signal having a frequency of 20 GHz or more using at least part of the first conductive member and the conductive area.

According to an example embodiment of the disclosure, an electronic device may include a housing including a first plate having a first surface, a second plate facing a direction opposite the first surface, and a side surface portion surrounding a space between the first plate and the second plate, the side surface portion including a conductive portion and at least one protrusion protruding from the conductive portion in an internal direction of the housing, a display exposed through at least part of the first plate, a first wireless communication circuit disposed inside the housing electrically connected to the at least one protrusion, and configured to transmit and/or receive a first signal having a frequency in a range of 6 GHz to 100 GHz, and a second wireless communication circuit disposed inside the housing electrically connected to a conductive portion, and configured to transmit and/or receive a second signal having a frequency in a range of 600 MHz to 6000 MHz.

According to various example embodiments disclosed in the disclosure, the additionally designed portion in the conventional legacy antenna structure may be minimized and/or reduced using the metal housing as a common radiator for the legacy antenna and the 5G antenna.

BRIEF DESCRIPTION OF THE DRAWINGS

The above and other aspects, features and advantages of certain embodiments of the present disclosure will be more apparent from the following detailed description, taken in conjunction with the accompanying drawings, in which.

With regard to description of drawings, similar components may be marked by similar reference numerals.

DETAILED DESCRIPTION

Hereinafter, various example embodiments of the disclosure will be described with reference to accompanying drawings. However, those of ordinary skill in the art will recognize that various modifications, equivalents, and/or alternatives on various embodiments described herein can be variously made without departing from the scope and spirit of the disclosure.

Figure 1:
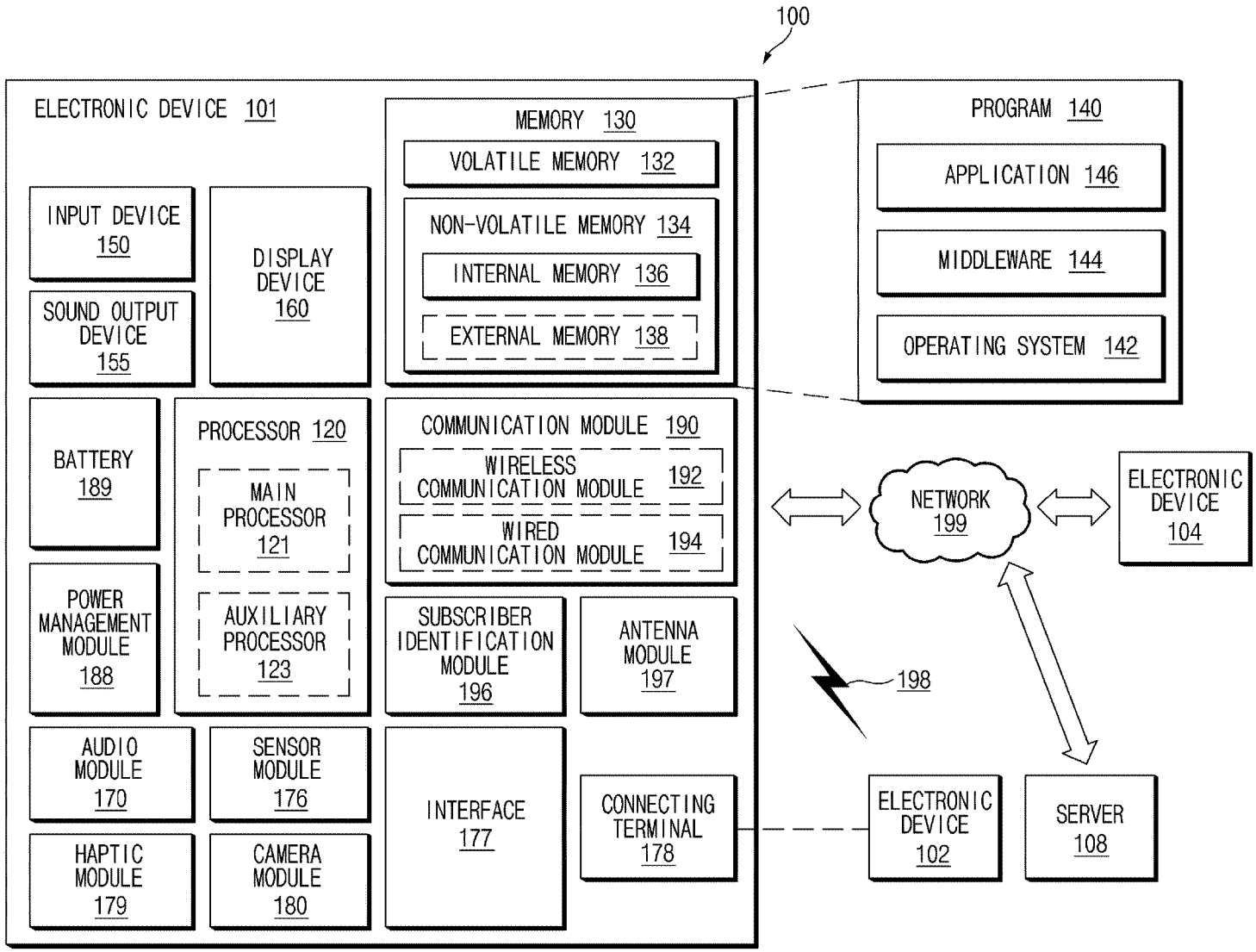
FIG. 1 is a block diagram illustrating an example electronic device in a network environment according to various embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to an example embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to an example embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted or received between the communication module 190 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

Figure 2:
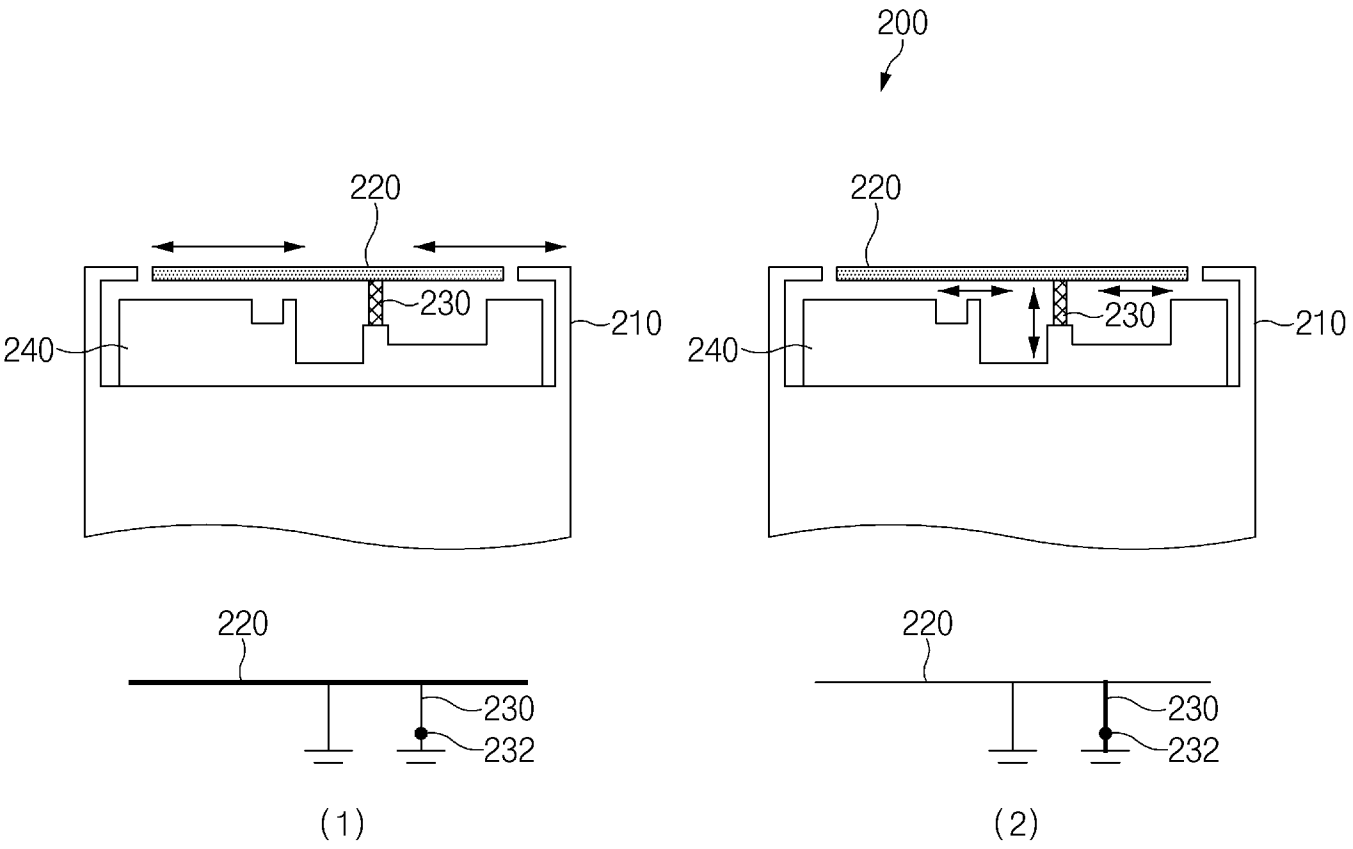
FIG. 2 is diagram illustrating an example electronic device and an antenna, according to an embodiment.

FIG. 2 is a diagram illustrating an example electronic device and an antenna, according to an embodiment.

In an example embodiment, an electronic device 200 may include a first antenna for transmitting and/or receiving the signal in a frequency band of 6 GHz or less and a second antenna for transmitting and/or receiving the signal (e.g., 5G) in a frequency band greater than 6 GHz. For example, it may be understood that the first antenna may, for example, be a legacy antenna and the second antenna may, for example, be the next-generation antenna.

In an example embodiment, the electronic device 200 (e.g., the electronic device 101 of FIG. 1) may include housing 210. At least part of the housing 210 may be formed a conductive material. For example, the housing 210 may include a conductive area 220. However, the size/shape of the conductive area formed in the housing 210 is not limited to the illustration of FIG. 2. In an embodiment, it may be understood that the housing 210 is metal housing.

Referring to FIG. 2 (1), in an embodiment, the first antenna may use at least part of the conductive area 220 of the housing 210, as a radiator. One point of the conductive area 220 may be electrically connected to the ground area inside the electronic device 200. The electronic device 200 may include a first wireless communication circuit (not illustrated) for feeding the first antenna. The first wireless communication circuit may be electrically connected to the conductive area 220. In an embodiment, the first antenna may, for example, operate as the inverted F-type antenna (IFA). For example, the current operation of the first antenna may be formed as the arrow of FIG. 2 (1).

In an embodiment, the electronic device 200 may include a first conductive member (e.g., including a conductive material) 230 in electrical contact with the conductive area 220. Referring to FIG. 2 (2), the second antenna may use at least part of the conductive area 220 of the housing 210 and at least part of the first conductive member 230, as a radiator. For example, the current operation of the second antenna may be formed as the arrow of FIG. 2 (2). The electronic device 200 may include a second wireless communication circuit (not illustrated) for feeding the second antenna. The second wireless communication circuit may be electrically connected to the first conductive member 230.

In an embodiment, the first conductive member 230 may be formed to protrude in the internal direction of the housing 210 from the conductive area 220. For example, the first conductive member 230 may be a flange formed to extend from the housing 210. In an embodiment, the electronic device 200 may include a printed circuit board 240. The first wireless communication circuit and the second wireless communication circuit may be disposed on or inside the printed circuit board 240.

Figure 3A:
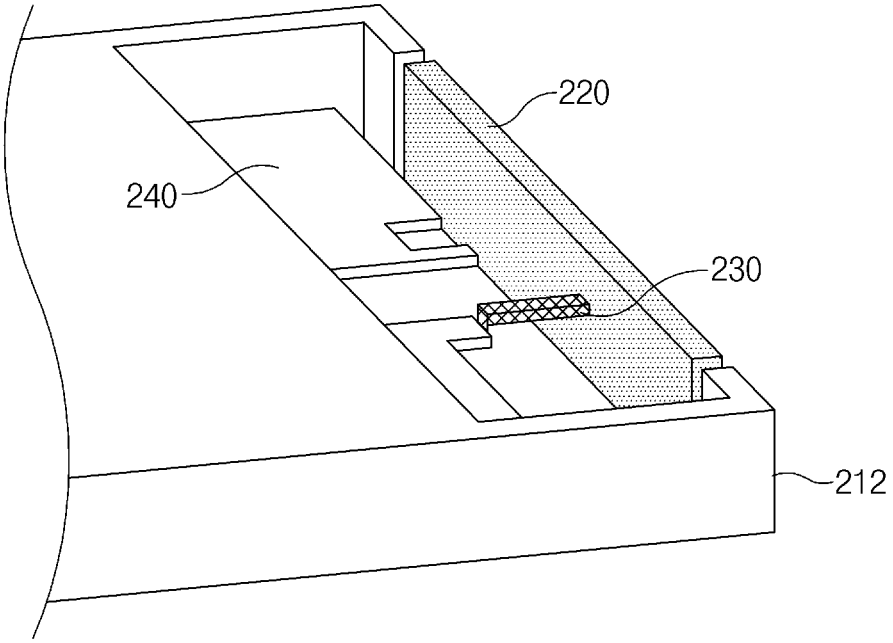
FIG. 3A is a perspective view illustrating an example electronic device, according to an embodiment.
Figure 3B:
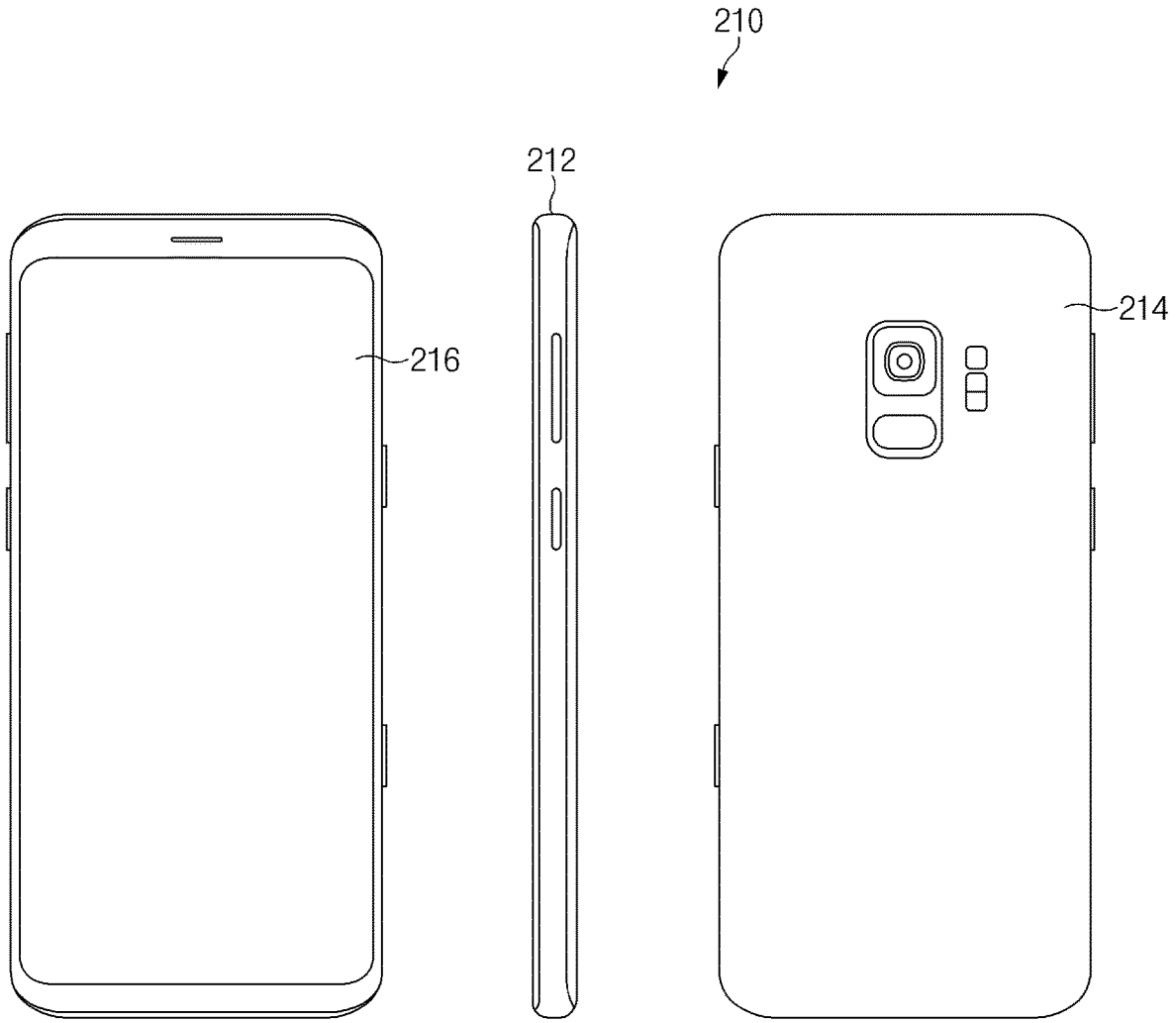
FIG. 3B includes various views of a housing of an example electronic device, according to an embodiment.
Figure 3C:
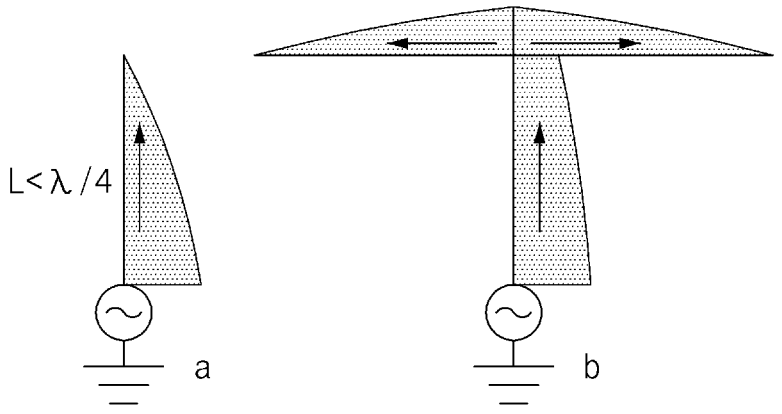
FIG. 3C is a diagram illustrating example operation of an antenna, according to an embodiment.
Figure 3C:
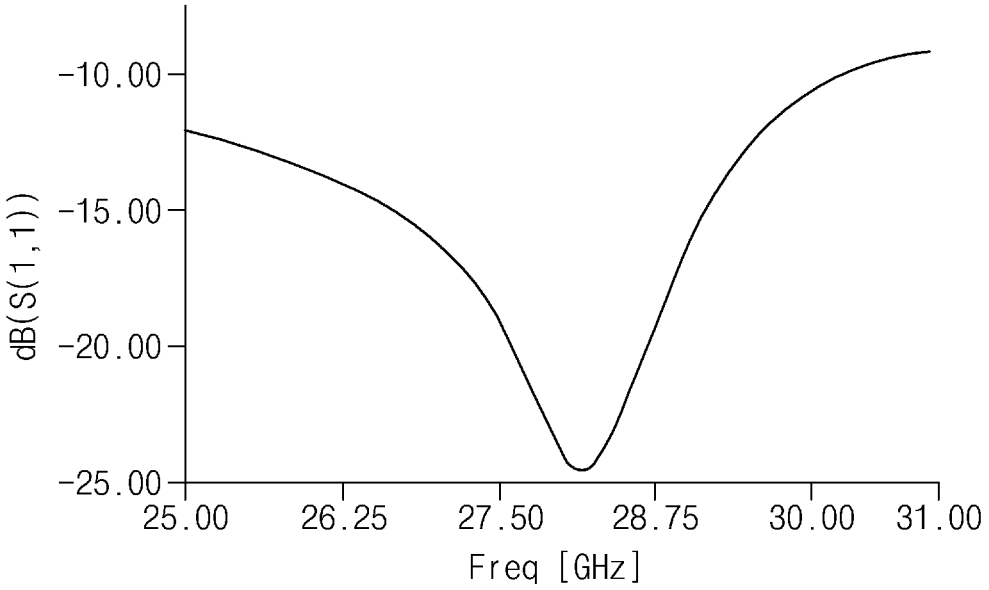

FIG. 3A is a perspective view illustrating an example electronic device, according to an embodiment. FIG. 3B includes various perspective views of the housing of an example electronic device, according to an embodiment. FIG. 3C is a diagram illustrating example operation of an antenna, according to an embodiment. Hereinafter, the structure of the electronic device will be described with reference to FIGS. 3A, 3B and 3C, by way of example.

Referring to FIG. 3B, the housing 210 may include a first surface 216, a second surface 214 facing in a direction opposite to the first surface 216, and a side surface 212 surrounding a space between the first surface 216 and the second surface 214.

Referring to FIG. 3A, according to an embodiment, the side surface 212 of the housing 210 may include the conductive area 220 (e.g., the conductive area 220 of FIG. 2). For example, the first conductive member 230 protruding from the conductive area 220 of the side surface 212 may operate as a part of the second antenna.

Referring to FIG. 3C (1), flow of current by the second antenna is illustrated. 'a' of FIG. 3C (1) illustrates the flow of current when a part of the first conductive member 230 operates as a monopole antenna. 'b' of FIG. 3C (1) illustrates the flow of current when a part of the conductive area 220 and a part of the first conductive member 230 operate as T antenna. The currents formed in different directions in the conductive area 220 may be canceled out. The second antenna may transmit and/or receive the signal in a frequency band formed by an electrical length formed in the first conductive member 230.

Referring to FIG. 3C (2), it may be understood that the resonance of the second antenna is formed at about 28 GHz.

Figure 4:
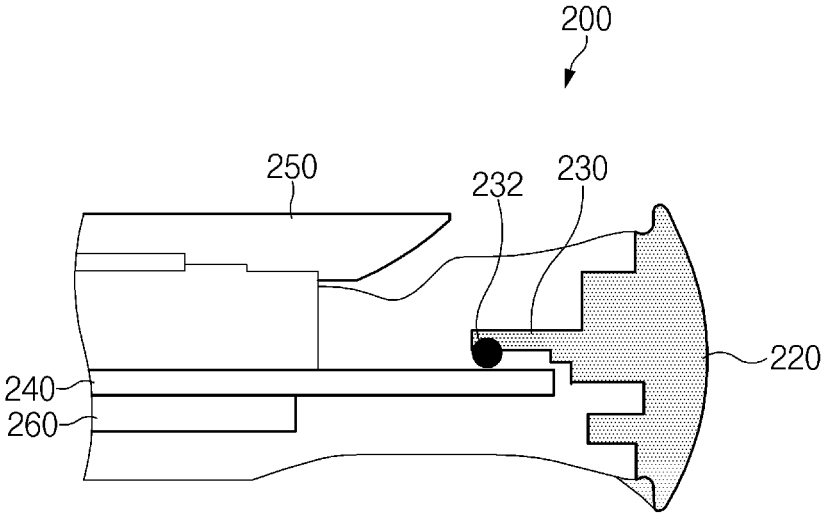
FIG. 4 is a sectional view of an example electronic device and a measurement result of a radiation pattern of a second antenna, according to an embodiment.
Figure 4:
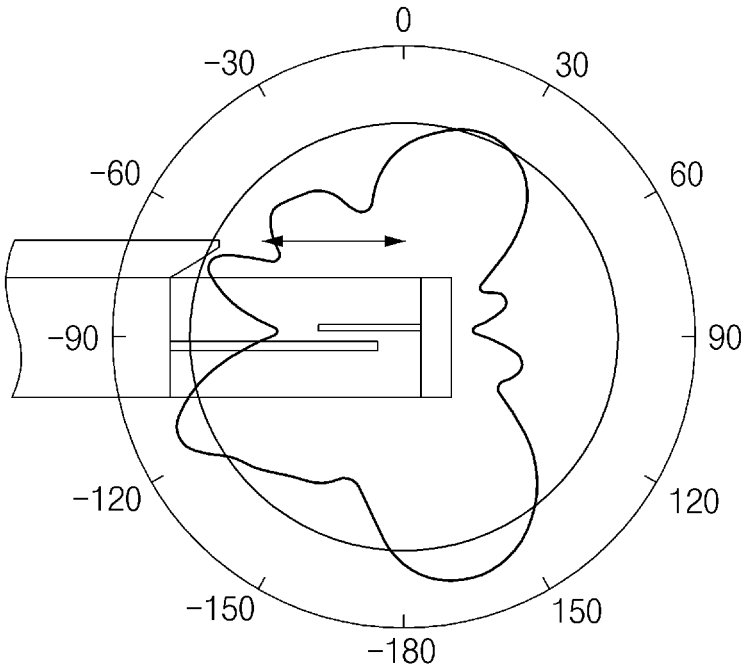

FIG. 4 is a sectional view of an example electronic device and the measurement result of a radiation pattern of a second antenna, according to an embodiment.

In various embodiments, the electronic device 200 may further include a display 250 (e.g., the display device 160 of FIG. 1) exposed through at least part of the first surface (e.g., the first surface 216 of FIG. 3B) of the housing 210. The electronic device 200 may include the printed circuit board 240 interposed between the display 250 and the second surface 214. For example, the printed circuit board 240 may include an upper surface facing the display 250 and a lower surface facing in the direction opposite to the upper surface. In an embodiment, a second wireless communication circuit 260 of the second antenna may be disposed on the lower surface of the printed circuit board 240.

The second wireless communication circuit 260 may feed one point 232 of the first conductive member 230. For example, it may be understood that the one point 232 is the feed point for the second antenna.

The display 250 may partially shield the electromagnetic wave of the second antenna. However, referring to the radiation pattern of FIG. 4 (2), it may be identified that the radiation pattern is partly formed between the display 250 and the conductive area 220.

Figure 5:
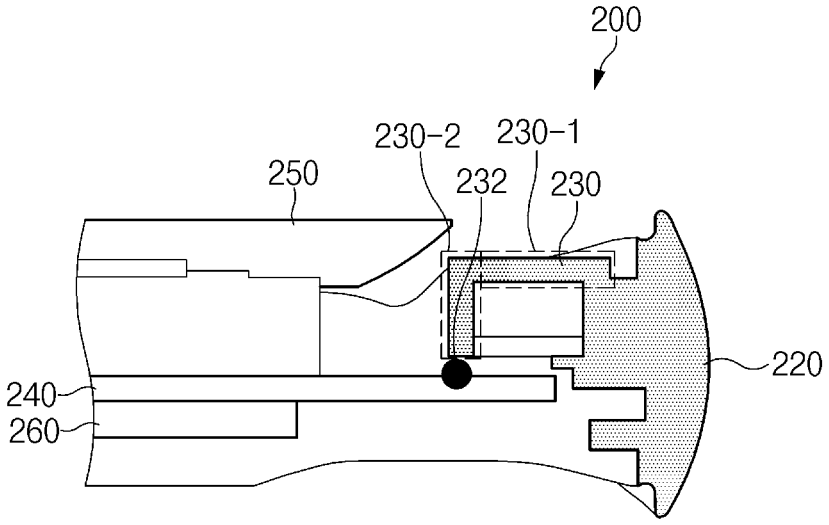
FIG. 5 is a sectional view of an example electronic device and a measurement result of a radiation pattern of a second antenna, according to an embodiment.
Figure 5:
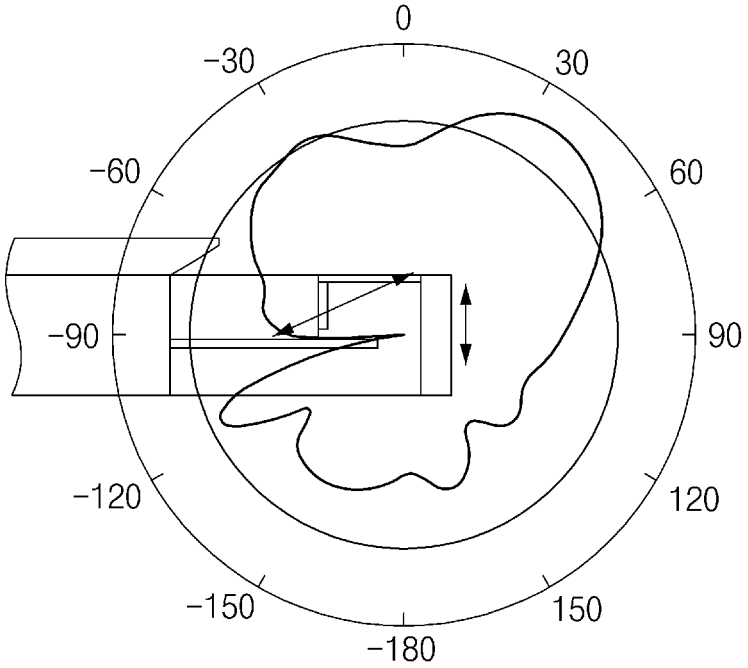

FIG. 5 is a sectional view illustrating an example electronic device and the measurement result of a radiation pattern of a second antenna, according to an embodiment.

In various embodiments, the first conductive member 230 (e.g., the first conductive member 230 of FIG. 4) may include a first portion 230-1 protruding from the conductive area 220 and a second portion 230-2 having an angle with the first portion 230-1. For example, the first portion 230-1 may be disposed more adjacent to the first surface (e.g., the first surface 216 of FIG. 3B) of the housing (e.g., the housing 210 of FIG. 3B) and the display 250 than the second surface (e.g., the second surface 214 of FIG. 3B) of the housing (e.g., the housing 210 of FIG. 3B).

In various embodiments, the first portion 230-1 may protrude from the conductive area 220 in parallel with the first surface 216 of the housing 210 and/or the display 250. The second portion 230-2 may extend in the direction facing the second surface 214 from the first surface 216 of the housing 210. For example, the first portion 230-1 and the second portion 230-2 may be disposed to be substantially perpendicular.

The second wireless communication circuit 260 may feed one point 232 of the second portion 230-2 of the first conductive member 230. For example, it may be understood that the one point 232 of the second portion 230-2 is the feed point for the second antenna.

Referring to FIG. 5 (2), a part of the first conductive member 230 may be disposed closer to the first surface (e.g., the first surface 216 of FIG. 3B) than the second surface (e.g., the second surface 214 of FIG. 3B) of the housing, and thus it may be identified that the radiation pattern of the second antenna formed in the space between the display 250 and the conductive area 220 of the side surface (e.g., the side surface 212 of FIG. 3B) is improved.

Figure 6:
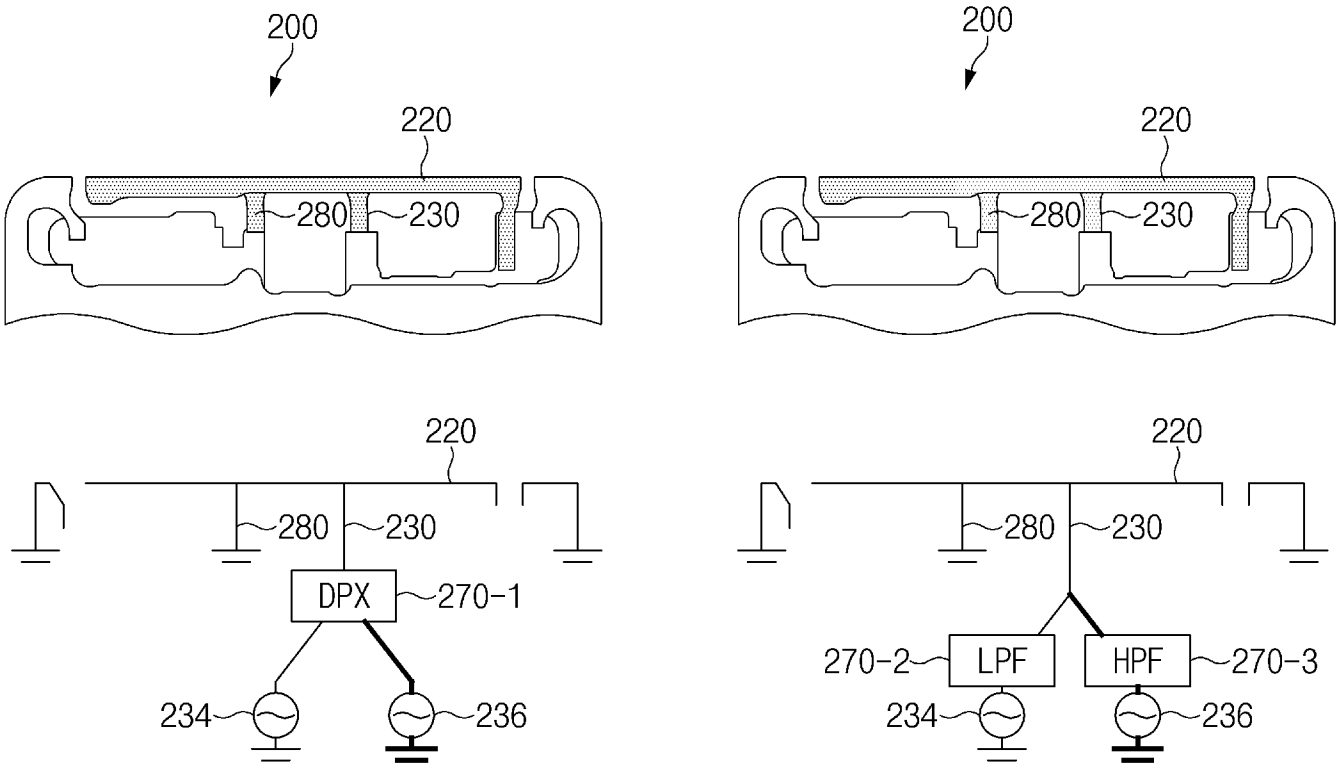
FIG. 6 is a diagram illustrating an example electronic device and an antenna, according to various embodiments.
Figure 7:
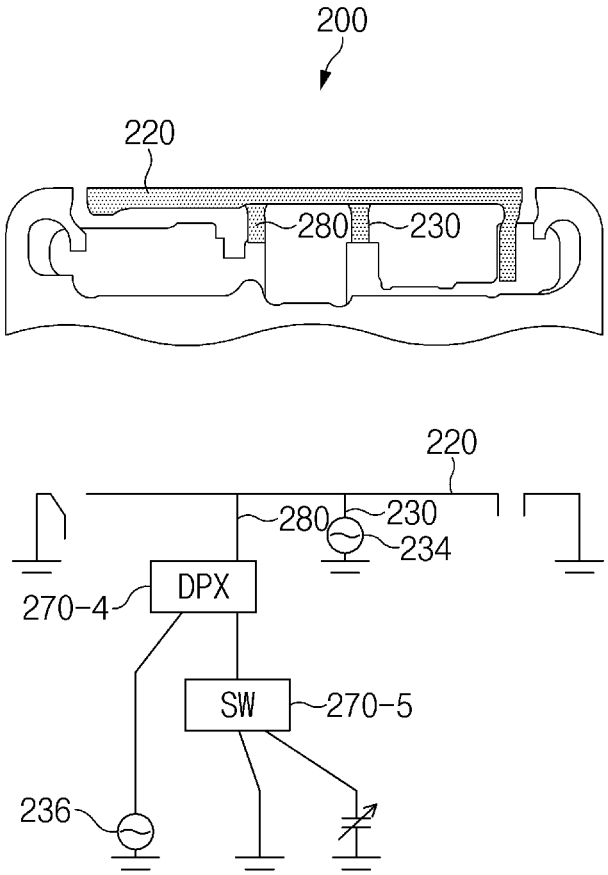
FIG. 7 is a diagram illustrating an example electronic device and an antenna, according to various embodiments.

FIGS. 6 and 7 are diagrams illustrating an example electronic device and an antenna, according to various embodiments.

In various embodiments, a first antenna may transmit or receive the first RF signal in a frequency band of 6 GHz or less; a second antenna may transmit or receive the second RF signal in a frequency band of 28 GHz or more.

In various embodiments, the electronic device 200 may include a diplexer 270-1. For example, the first wireless communication circuit may transmit and/or receive the first RF signal separated by the diplexer 270-1. The second wireless communication circuit may transmit and/or receive the second RF signal separated by the diplexer 270-1. For example, the diplexer 270-1 may be electrically connected to a first feed point 234 for the first antenna and a second feed point 236 for the second antenna. The diplexer 270-1 may be disposed on the electrical path between the first feed point 234 and the conductive area 220 and on the electrical path between the second feed point 236 and the first conductive member 230.

In various embodiments, the electronic device 200 may include a low pass filter (LPF) 270-2 and a high pass filter (HPF) 270-3. For example, the first wireless communication circuit may transmit and/or receive the first RF signal filtered by the LPF 270-2; the second wireless communication circuit may transmit and/or receive the second RF signal filtered by the HPF 270-3. The LPF 270-2 may be disposed on the electrical path between the first feed point 234 and the conductive area 220. The HPF 270-3 may be disposed on the electrical path between the second feed point 236 and the first conductive member 230.

For example, the conductive area 220 may be connected to the ground area inside the electronic device 200 by a second conductive member 280. Accordingly, one point of the second conductive member 280 may be referred to as the ground point of the conductive area 220. In various embodiments, the electronic device 200 may include a switch 270-5 disposed on an electrical path between the ground point of the conductive area 220 and the ground area within the electronic device 200. The ground point may be selectively and electrically connected to the ground area by the operation of switch 270-5. The electronic device 200 may include a diplexer 270-4 disposed on a path between the second feed point 236 for the second antenna and the ground point of the conductive area 220. In the case of the second antenna, the signal transmitted to the second conductive member 280 may be separated by diplexer 270-4 into the mmWave band and the band of 6 GHz or less; the second conductive member 280 operates as the ground for the first antenna in the band of 6 GHz or less, and the second conductive member 280 operates as the second antenna in the mmWave band.

Figure 8A:
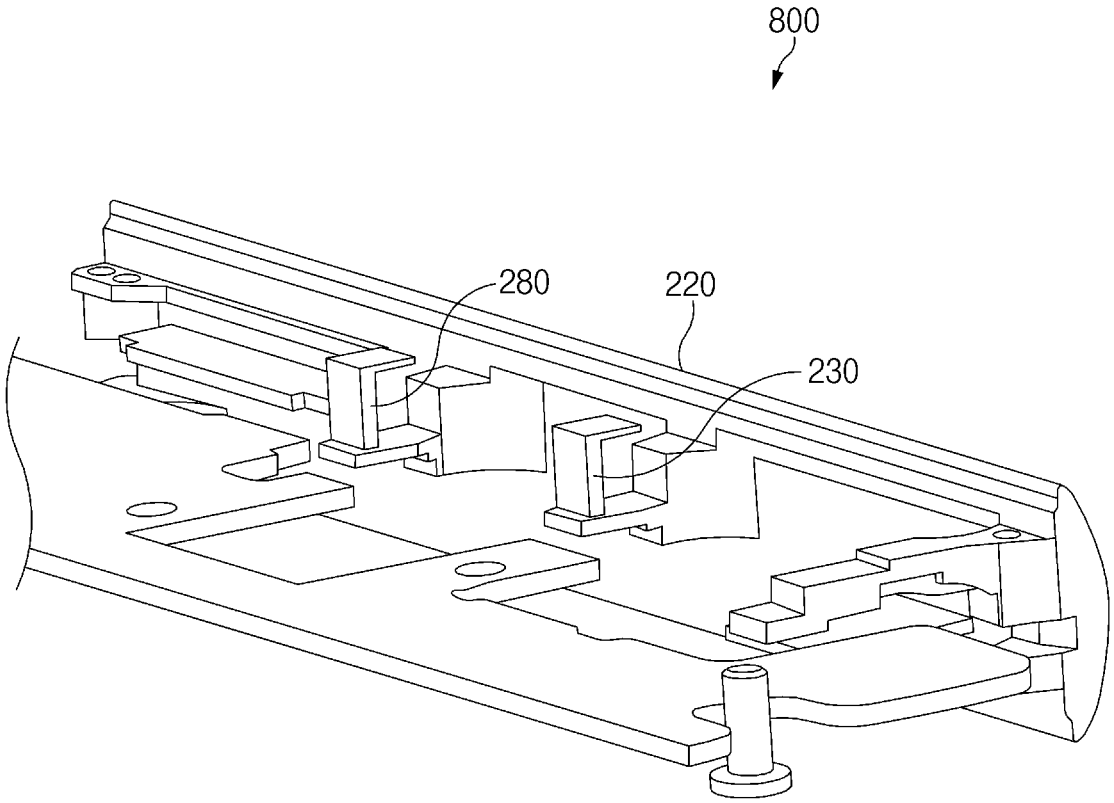
FIG. 8A is a perspective view illustrating an example electronic device, according to various embodiments.
Figure 8B:
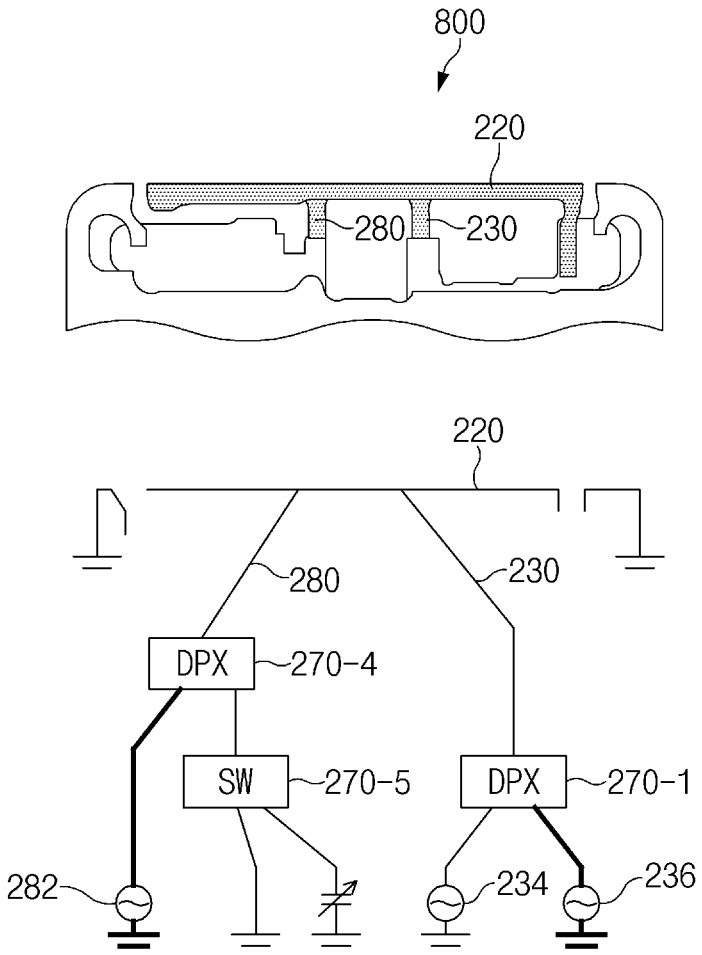
FIG. 8B is a diagram illustrating an example antenna, according to various embodiments.
Figure 9:
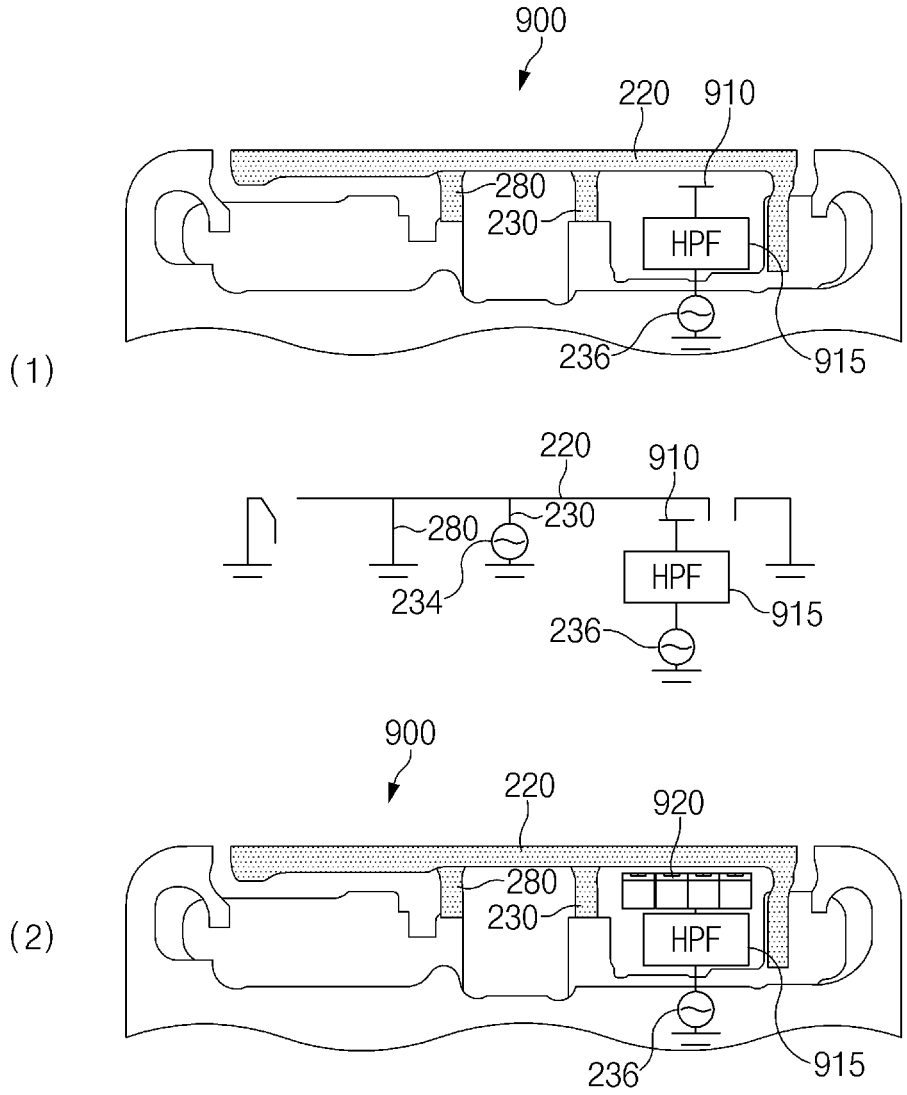
FIG. 9 is a diagram illustrating an example antenna, according to various embodiments.

FIG. 8A is a perspective view illustrating an example electronic device, according to various embodiments. FIGS. 8B and 9 are diagrams illustrating examples of an example antenna, according to various embodiments.

In various embodiments, the second conductive member 280 electrically connected to the conductive area 220 (e.g., the conductive area 220 of FIG. 2) of an electronic device 800 and disposed spaced from the first conductive member 230 (e.g., the first conductive member 230 of FIG. 2) may be further included. The second conductive member 280 may be electrically connected to the ground area in the electronic device 800.

Referring to FIG. 8A, according to various embodiments, the double feed structure for the second antenna may be implemented. For example, the 2-port feeding may be possible via one point of the first conductive member 230 and one point of the second conductive member 280.

Referring to FIG. 8B, the electronic device 800 may include the first feed point 234 for the first antenna, the second feed point 236 for the second antenna, and a third feed point 282.

In an embodiment, the electronic device 800 may include the diplexer 270-1 disposed between the conductive area 220 and the second feed point 236 and may include the diplexer 270-4 disposed between the conductive area 220 and the third feed point 282.

In an embodiment, the right-side structure associated with the second feed point 236 corresponds to a structure, to which the diplexer 270-1 is applied, from among the structures described above in FIG. 6 and may have substantially the same operating principle. The left-side structure associated with the third feed point 282 corresponds to the structure, to which the diplexer 270-4 and the switch 270-5 described above in FIG. 7 are applied, and may have substantially the same operating principle. In this way, two feed structures for the second antenna may be implemented by changing the feed structure for the first antenna and the ground structure for the conductive area 220.

Referring to FIG. 9, in various embodiments, the feed structure for the second antenna may be implemented by the indirect feeding method. In this case, the IFA structure of the first antenna may be maintained; the first feed point 234 for the first antenna may be included in the first conductive member 230.

Referring to FIG. 9 (1), an electronic device 900 (e.g., the electronic device 100 of FIG. 2) may further include a conductive pattern 910. The electronic device 900 may include an HPF 915 between the conductive pattern 910 and the second feed point 236 for the second antenna. The conductive area 220 may be indirectly fed through the coupling with the conductive pattern 910. The second wireless communication circuit may transmit and/or receive the RF signal separated by the HPF 915.

Referring to FIG. 9 (2), the electronic device 900 may further include an antenna array module (e.g., including one or more antennas) 920. The electronic device 900 may include the HPF 915 between the antenna array module 920 and the second feed point 236 for the second antenna. The conductive area 220 may be indirectly fed through the coupling with the antenna array module 920. The second wireless communication circuit may transmit and/or receive the RF signal separated by the HPF 915.

Figure 10:
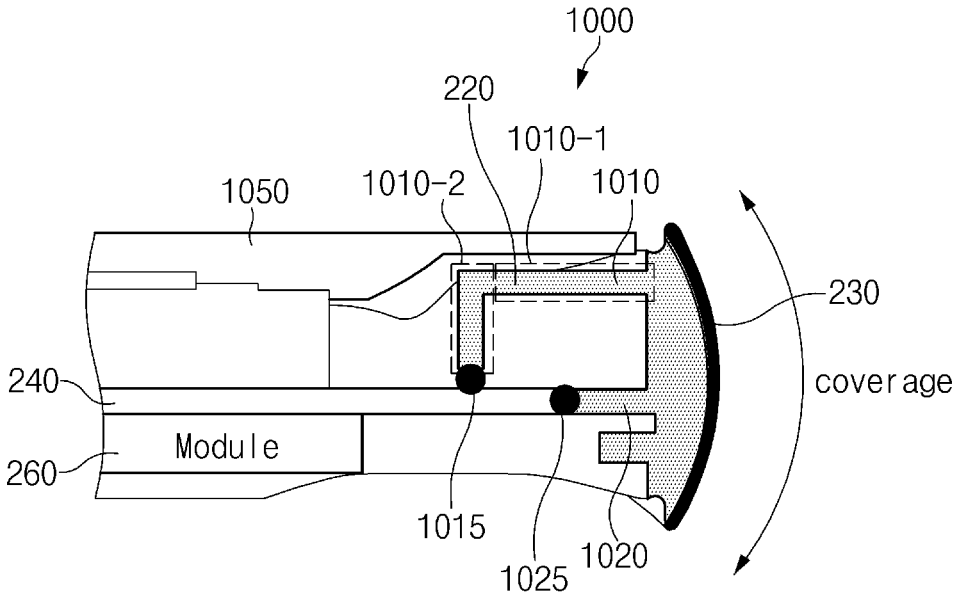
FIG. 10 is a diagram illustrating an example electronic device, to which a full display is applied, and an antenna, according to various embodiments.
Figure 10:
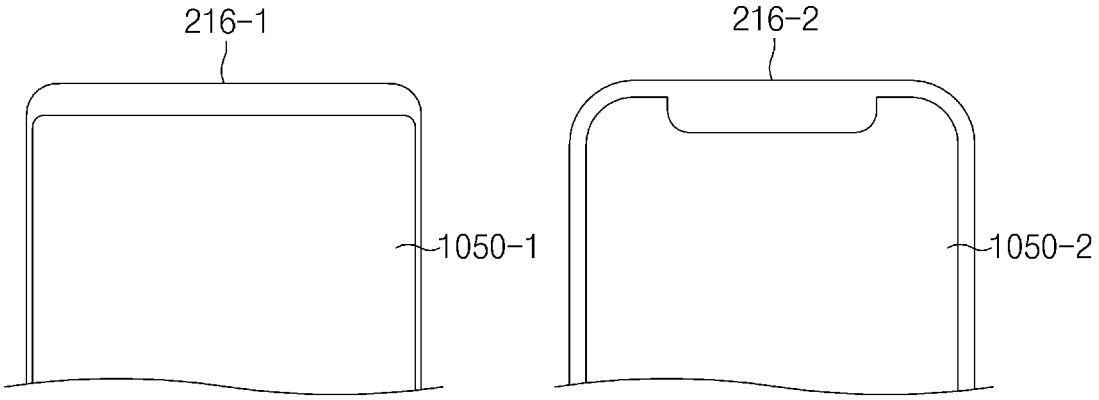
Figure 11:
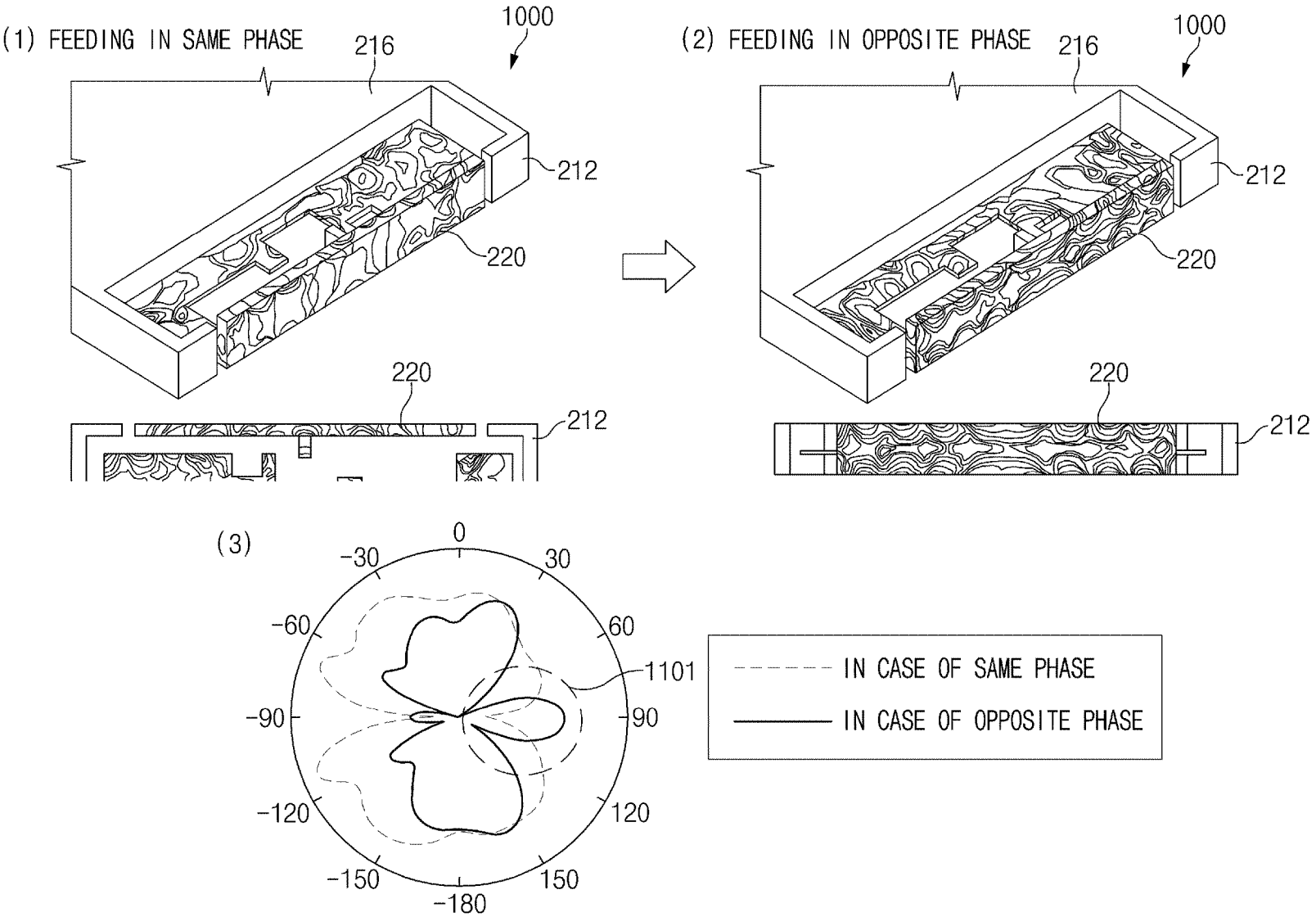
FIG. 11 is a diagram illustrating a radiation pattern according to an example current operation and feeding method, according to various embodiments.
Figure 12:
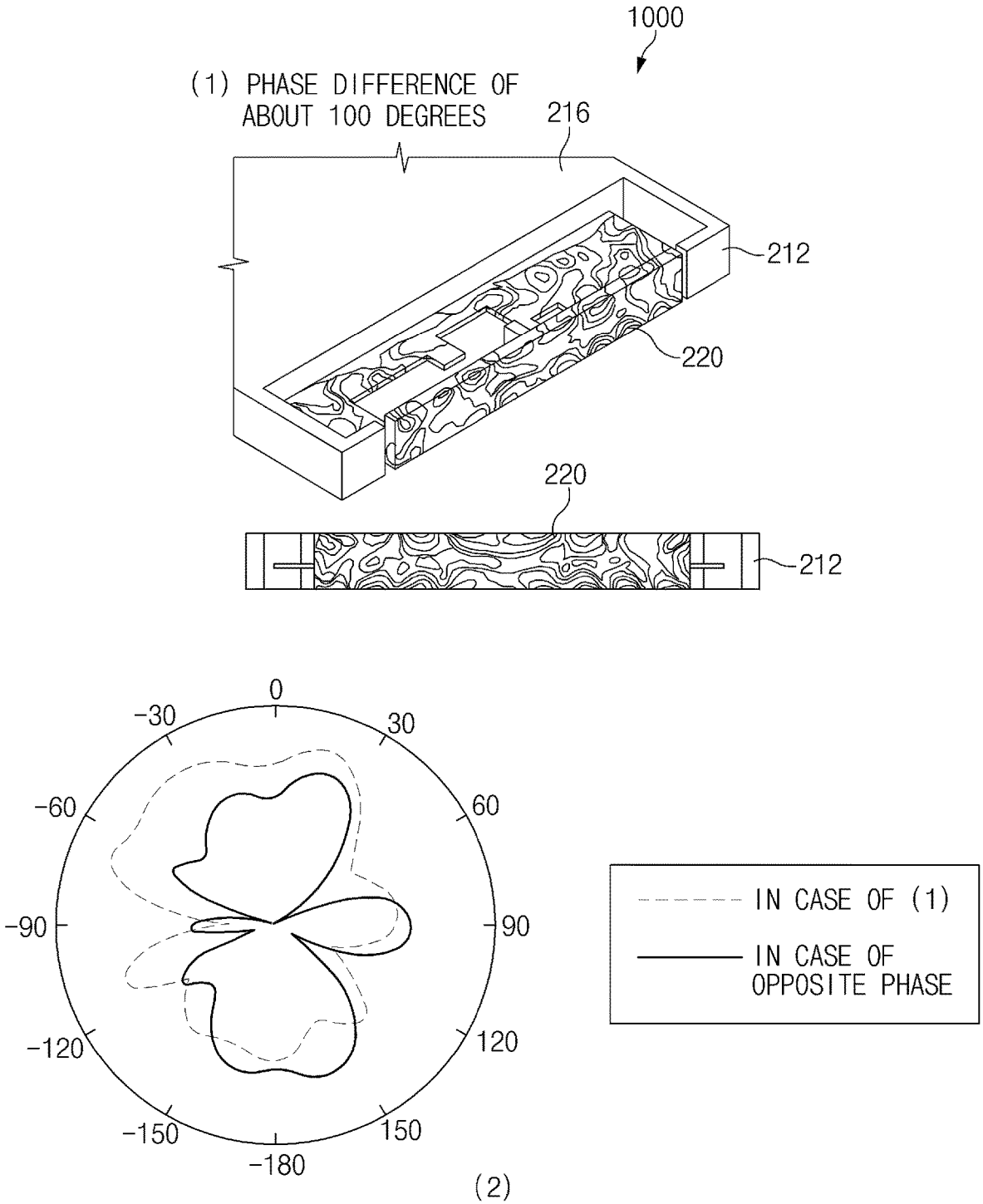
FIG. 12 is a diagram illustrating a radiation pattern according to an example current operation and feeding method, according to various embodiments.

FIG. 10 is a diagram illustrating an example electronic device, to which a full display is applied, and an antenna, according to various embodiments. FIGS. 11 and 12 illustrate example radiation patterns according to a current operation and feeding method, according to various embodiments.

In various embodiments, most of the area of the first surface (e.g., the first surface 216 of FIG. 3B) of the housing (e.g., the housing 210 of FIG. 3B) of an electronic device 1000 may be formed of a display 1050. In this case, the radiated electromagnetic wave in the direction of the first surface of the housing may be mostly shielded. For example, the display 1050 may be formed such as a display 1050-1 formed on the first surface 216-1, which has the first shape, or a display 1050-2 formed on the first surface 216-2 that has the second shape.

The electronic device 1000 may include a first conductive member 1010 in electrical contact with the conductive area 220 and a second conductive member 1020 in electrical contact with the conductive area 220. For example, the first conductive member 1010 may have a structure similar to the conductive member 230 described above with reference to FIG. 5. The first conductive member 1010 may include a first portion 1010-1 and a second portion 1010-2 having a predetermined angle with the first portion 1010-1. The second antenna may include a first feed point 1015 which is one point of the first conductive member 1010 and a second feed point 1025 that is one point of the second conductive member 1020.

Referring to FIG. 11, the first feed point 1015 and the second feed point 1025 may be fed in the same or opposite phase. Referring to FIG. 11 (1), when each of the first feed point 1015 and the second feed point 1025 is fed in the same phase, one portion of the conductive area 220 adjacent to the first surface 216 of the housing 210 and one portion of the conductive area 220 adjacent to the second surface 214 may mainly operate as the main radiator.

Referring to FIG. 11 (2), when each of the first feed point 1015 and the second feed point 1025 is fed in opposite phases (the difference in phase is 180 degrees), the conductive area 220 of the housing 210 may mainly operate as a radiator.

Referring to a portion 1101 of the radiation pattern of FIG. 11 (3), it may be understood that the beam pattern is mainly formed in the direction of the side surface 212. Furthermore, referring to FIG. 11 (2), it may be understood that the current operation is formed in the conductive area 220 included in the side surface 212.

In various embodiments, for the purpose of steering the beam formed by the second antenna, it is possible to change the phase of the feed for the first feed point 1015 and the second feed point 1025. Referring to FIG. 12, the second wireless communication circuit may perform feeding in a phase difference between the first feed point 1015 and the second feed point 1025, which is 100 degrees. Referring to FIGS. 12 (1) and (2), as the current operation is changed, the radiation pattern may be steered in the direction of the first surface 216.

Figure 13:
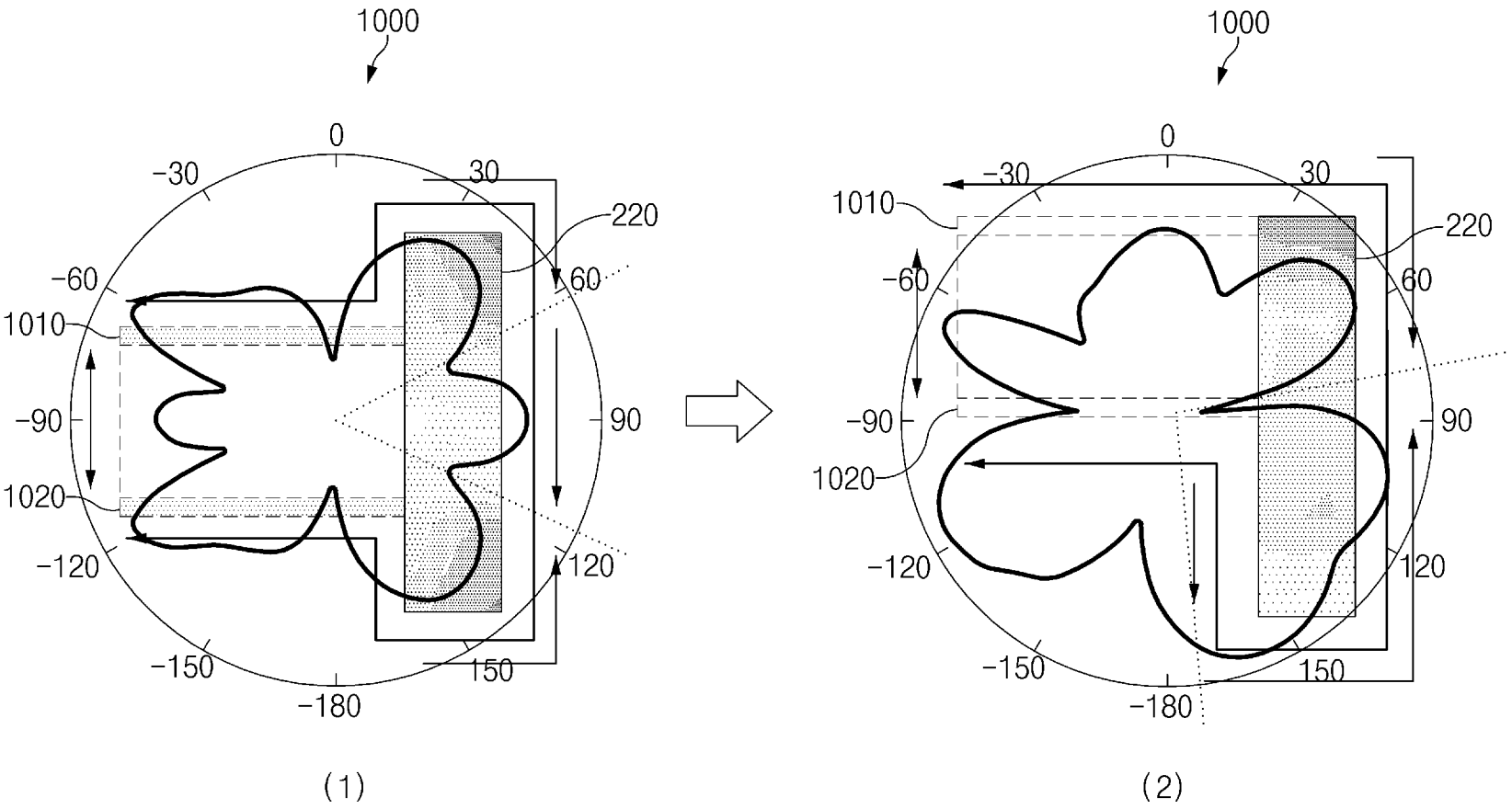
FIG. 13 is a diagram illustrating an example current operation formed depending on a location, at which conductive members are positioned, and a beam pattern of a second antenna, according to various embodiments.

FIG. 13 is a diagram illustrating an example current operation formed depending on a location, at which conductive members are positioned, and a beam pattern of a second antenna, according to various embodiments.

In various embodiments, the beam pattern of the second antenna may be changed depending on the locations of the first conductive member 1010 and the second conductive member 1020. The structure of FIG. 13 (1) may correspond to the structure described above with reference to FIGS. 10 to 12.

When the structure of FIG. 13 (2) is compared with the structure of (1), the first conductive member 1010 and the second conductive member 1020 may be disposed closer to the first surface (e.g., the first surface 216 of FIG. 3B). As such, it may be seen that the radiation pattern of the second antenna is formed in the forward direction of the side surface 212. According to the location at which the first conductive member 1010 and the second conductive member 1020 are disposed, the radiation pattern of the second antenna may be steered.

According to an example embodiment of the disclosure, the electronic device may include the housing including the conductive area, the first conductive member comprising a conductive material in electrical contact with the conductive area, a first wireless communication circuit electrically connected to the conductive area, and a second wireless communication circuit electrically connected to the first conductive member. The first wireless communication circuit transmits and/or receives a first signal having a frequency of 6 GHz or less, using the conductive area, and the second wireless communication circuit transmits and/or receives a second signal having a frequency of 20 GHz or more, using at least part of the first conductive member and the conductive area.

According to an example embodiment of the disclosure, the first conductive member may protrude in an internal direction of the housing from the conductive area.

According to an example embodiment of the disclosure, the housing may include a first surface, a second surface facing a direction opposite the first surface, and a side surface surrounding a space between the first surface and the second surface.

According to an example embodiment of the disclosure, the side surface may include the conductive area.

According to an example embodiment of the disclosure, the electronic device may further include a display viewable through at least part of the first surface.

According to an example embodiment of the disclosure, the electronic device may further include a printed circuit board including an upper surface facing the display and a lower surface facing a direction opposite the upper surface. The second wireless communication circuit may be disposed on the lower surface.

According to an example embodiment of the disclosure, the first conductive member may include a first portion −1 protruding from the conductive area and a second portion having a predetermined angle with the first portion. The first portion may be disposed adjacent to the first surface.

According to an example embodiment of the disclosure, the first portion may protrude from the conductive area in parallel with the first surface. The second portion may extend toward the second surface from the first surface.

According to an example embodiment of the disclosure, a point of the conductive area is electrically connected to a ground area inside the electronic device.

According to an example embodiment of the disclosure, the electronic device may further include a second conductive member in electrical contact with the conductive area and disposed spaced from the first conductive member. The second conductive member electrically connected to a ground area inside the electronic device.

According to an example embodiment of the disclosure, the second wireless communication circuit may be electrically connected to a first point of the first conductive member and a second point of the second conductive member.

According to an example embodiment of the disclosure, the electronic device may further include a switch interposed between the ground area and the second conductive member. The switch may be configured to electrically disconnect or connect the second conductive member to the ground area.

According to an example embodiment of the disclosure, the first wireless communication circuit may be electrically connected to the first point of the first conductive member. The second wireless communication circuit is electrically connected to the first point.

According to an example embodiment of the disclosure, the electronic device may further include a diplexer electrically connected to the first wireless communication circuit and the second wireless communication circuit. The first wireless communication circuit may be configured to receive the first signal separated by the diplexer. The second wireless communication circuit may be configured to receive the second signal separated by the diplexer.

According to an example embodiment of the disclosure, the first wireless communication circuit may be configured to receive the first signal filtered by an LPF electrically connected to the first wireless communication circuit. The second wireless communication circuit may be configured to receive the second signal filtered by an HPF electrically connected to the second wireless communication circuit.

According to an example embodiment of the disclosure, the electronic device may further include a second conductive member in electrical contact with the conductive area and disposed spaced from the first conductive member. The second wireless communication circuit is configured to be electrically connected to a second point of the second conductive member and to receive the second signal by feeding a first point of the first conductive member and the second point.

According to an example embodiment of the disclosure, the housing may include a first surface, a second surface facing a direction opposite the first surface, and a side surface surrounding a space between the first surface and the second surface. The electronic device may further include a display forming the first surface.

According to an embodiment of the disclosure, the first conductive member and the second conductive member may be disposed in parallel with the display. According to an example embodiment of the disclosure, the second wireless communication circuit may be configured to transmit and/or receive the second signal having a beam pattern in a direction in which the display faces.

According to an embodiment of the disclosure, the first conductive member includes a first portion protruding from the conductive area and a second portion having a predetermined angle with the first portion. The first portion is disposed adjacent to the display.

According to an example embodiment of the disclosure, an electronic device may include a housing including a first plate having a first surface, a second plate facing a direction opposite the first surface, and a side surface surrounding a space between the first plate and the second plate, a display viewable through at least part of the first plate, a first wireless communication circuit disposed inside the housing, electrically connected to the at least one protrusion, and transmitting and/or receiving a first signal having a frequency in a range of 6 GHz to 100 GHz, and a second wireless communication circuit disposed inside the housing, electrically connected to the conductive portion, and transmitting and/or receiving a second signal having a frequency in a range of 600 MHz to 6000 MHz. The side surface includes a conductive portion and at least one protrusion (e.g., the first conductive member 230 of FIG. 3A) protruding from the conductive portion in an internal direction of the housing.

According to an example embodiment of the disclosure, the electronic device may further include a first printed circuit board including a first surface facing the second plate and a second surface facing a direction opposite the first surface, inside the housing.

According to an example embodiment of the disclosure, the electronic device may further include at least one conductive patch disposed on the first printed circuit board or on the first surface of the first printed circuit board and electrically connected to the first wireless communication circuit.

According to an example embodiment of the disclosure, the first wireless communication circuit may be disposed on the second surface of the first printed circuit board.

According to an example embodiment of the disclosure, the at least one protrusion may include a first protrusion and a second protrusion at least partly overlapping the first protrusion when viewed from above the first plate.

According to an example embodiment of the disclosure, the first the printed circuit board may include a peripheral portion interposed between the first protrusion and the second protrusion.

According to an example embodiment of the disclosure, the electronic device may further include at least one flexible conductive member between the peripheral portion and the protrusion.

According to an example embodiment of the disclosure, the at least one protrusion may further include a third protrusion not overlapping with the first protrusion when viewed from above the first plate and a fourth protrusion at least partly overlapping with the third protrusion when viewed from above the first plate.

According to an example embodiment of the disclosure, the first protrusion and the second protrusion may together define a first feed part, and the third protrusion and the fourth protrusion may together define a second feed part.

According to an example embodiment of the disclosure, the first wireless communication circuit may be configured to provide a single beam, using the first feed part and the second feed part.

According to an example embodiment of the disclosure, the electronic device may further include a second printed circuit board disposed inside the housing. The second wireless communication circuit may be disposed on the second printed circuit board.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), the element may be coupled with the other element directly (e.g., wiredly), wirelessly, or via a third element.

As used herein, the term "module" may include a unit implemented in hardware, software, or firmware, or any combination thereof, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the "non-transitory" storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

While the disclosure has been illustrated and described with reference to various example embodiments thereof, it will be understood that the various example embodiments are intended to be illustrative, not limiting, and one of ordinary skill in the art will understand that various changes in form and detail may be made without departing from the true spirit and full scope of the disclosure.

What is claimed is:

1. An electronic device comprising:

a housing including a conductive area;

a first conductive member comprising a conductive material in electrical contact with the conductive area;

a first wireless communication circuit electrically connected to the conductive area;

a second wireless communication circuit electrically connected to the first conductive member, wherein the first wireless communication circuit is configured to transmit and/or receive a first signal having a frequency of 6 GHz or less using the conductive area, and wherein the second wireless communication circuit is configured to transmit and/or receive a second signal having a frequency of 20 GHz or more using at least part of the first conductive member and the conductive area; and a second conductive member comprising a conductive material in electrical contact with the conductive area and disposed to be spaced from the first conductive member, wherein the second conductive member is electrically connected to a ground area inside the electronic device.

2. The electronic device of claim 1, wherein the first conductive member protrudes from the conductive area in an internal direction of the housing.

3. The electronic device of claim 1, wherein the housing includes a first surface, a second surface facing a direction opposite direction the first surface, and a side surface surrounding a space between the first surface and the second surface.

4. The electronic device of claim 3, wherein the side surface includes the conductive area.

5. The electronic device of claim 3, wherein the first conductive member includes a first portion protruding from the conductive area and a second portion having a predetermined angle with the first portion, and wherein the first portion is disposed adjacent to the first surface.

6. The electronic device of claim 5, wherein the first portion protrudes from the conductive area in parallel with the first surface, and wherein the second portion extends toward the second surface from the first surface.

7. The electronic device of claim 1, wherein a point of the conductive area is electrically connected to a ground area inside the electronic device.

8. The electronic device of claim 1, wherein the second wireless communication circuit is electrically connected to a first point of the first conductive member and a second point of the second conductive member.

9. The electronic device of claim 8, further comprising:

a switch disposed between a ground area and the second conductive member, wherein the switch is configured to electrically disconnect and/or connect the second conductive member to the ground area.

10. The electronic device of claim 1, further comprising:

a diplexer electrically connected to the first wireless communication circuit and the second wireless communication circuit, wherein the first wireless communication circuit is configured to receive the first signal separated by the diplexer, and wherein the second wireless communication circuit is configured to receive the second signal separated by the diplexer.

11. The electronic device of claim 1, wherein the first wireless communication circuit is configured to receive the first signal filtered by a low pass filter electrically connected to the first wireless communication circuit, and wherein the second wireless communication circuit is configured to receive the second signal filtered by a high pass filter electrically connected to the second wireless communication circuit.

12. An electronic device comprising:

a housing including a conductive area;

a first conductive member comprising a conductive material in electrical contact with the conductive area;

a first wireless communication circuit electrically connected to the conductive area; and a second wireless communication circuit electrically connected to the first conductive member, wherein the first wireless communication circuit is configured to transmit and/or receive a first signal having a frequency of 6 GHz or less using the conductive area, and wherein the second wireless communication circuit is configured to transmit and/or receive a second signal having a frequency of 20 GHz or more using at least part of the first conductive member and the conductive area, wherein the first wireless communication circuit is electrically connected to a first point of the first conductive member, and wherein the second wireless communication circuit is electrically connected to the first point.

13. An electronic device of comprising:

a housing including a conductive area;

a first conductive member comprising a conductive material in electrical contact with the conductive area;

a first wireless communication circuit electrically connected to the conductive area;

a second wireless communication circuit electrically connected to the first conductive member, wherein the first wireless communication circuit is configured to transmit and/or receive a first signal having a frequency of 6 GHz or less using the conductive area, and wherein the second wireless communication circuit is configured to transmit and/or receive a second signal having a frequency of 20 GHz or more using at least part of the first conductive member and the conductive area; and a second conductive member comprising a conductive material in electrical contact with the conductive area and disposed to be spaced from the first conductive member, and wherein the second wireless communication circuit is electrically connected to a second point of the second conductive member and is configured to receive the second signal by feeding a first point of the first conductive member and a second point.

14. An electronic device comprising:

a housing including a first plate having a first surface, a second plate facing a direction opposite direction the first surface, and a side surface surrounding a space between the first plate and the second plate, wherein the side surface includes:

a conductive portion; and at least one protrusion protruding from the conductive portion in direction toward an inside of the housing;

a display viewable through at least part of the first plate;

a first wireless communication circuit disposed inside the housing, electrically connected to the at least one protrusion, and configured to transmit and/or receive a first signal having a frequency in a range of 6 GHz to 100 GHz;

a second wireless communication circuit disposed inside the housing, electrically connected to the conductive portion, and configured to transmit and/or receive a second signal having a frequency in a range of 600 MHz to 6000 MHz;

a first printed circuit board including a first surface facing the second plate and a second surface facing a direction opposite the first surface, the first printed circuit board being disposed inside the housing; and at least one conductive patch disposed on the first printed circuit board and electrically connected to the first wireless communication circuit.

15. The electronic device of claim 14, wherein the first wireless communication circuit is disposed on the second surface of the first printed circuit board.

16. The electronic device of claim 14, wherein the at least one protrusion includes:

a first protrusion, and a second protrusion at least partly overlapping the first protrusion when viewed from above the first plate.

17. An electronic device, comprising:

a housing including a first plate having a first surface, a second plate facing a direction opposite direction the first surface, and a side surface surrounding a space between the first plate and the second plate, wherein the side surface includes:

a conductive portion, and at least one protrusion protruding from the conductive portion in direction toward an inside of the housing;

a display viewable through at least part of the first plate;

a first wireless communication circuit disposed inside the housing, electrically connected to the at least one protrusion, and configured to transmit and/or receive a first signal having a frequency in a range of 6 GHz to 100 GHz;

a second wireless communication circuit disposed inside the housing, electrically connected to the conductive portion, and configured to transmit and/or receive a second signal having a frequency in a range of 600 MHz to 6000 MHz; and a first printed circuit board including a first surface facing the second plate and a second surface facing a direction opposite the first surface, the first printed circuit board being disposed inside the housing, wherein the at least one protrusion includes: a first protrusion, and a second protrusion at least partly overlapping the first protrusion when viewed from above the first plate, and wherein the first printed circuit board includes a peripheral portion interposed between the first protrusion and the second protrusion.

* * * * *